United States Patent [19]

Barouh et al.

[11] 4,239,832

[45] * Dec. 16, 1980

[54] ADHESIVELY CORRECTABLE TRANSFER MEDIUM WITH DELAYED ALTERATION RESISTANCE CHARACTERISTICS

[75] Inventors: Victor Barouh, Old Westbury; George Rottmann, Jackson Heights; Salvatore DeSimone, Brooklyn, all of N.Y.

[73] Assignee: Eaton Allen Corp., Brooklyn, N.Y.

[ * ] Notice: The portion of the term of this patent subsequent to Jul. 17, 1996, has been disclaimed.

[21] Appl. No.: 965,166

[22] Filed: Nov. 30, 1978

Related U.S. Application Data

[60] Division of Ser. No. 817,773, Jul. 21, 1977, which is a continuation-in-part of Ser. No. 781,023, Mar. 24, 1977, Pat. No. 4,161,551.

[51] Int. Cl.[3] ..... B41J 31/05; B41J 31/06; B41M 3/14

[52] U.S. Cl. ..... 428/539; 106/20; 106/22; 283/8 B; 283/9 R; 400/237; 427/7; 428/307; 428/915; 428/916

[58] Field of Search ..... 101/426; 106/20–23, 106/27, 28; 283/8 R, 8 A, 8 B, 9 R, 9 A; 427/7, 141, 152, 153; 428/307, 469, 539, 914, 915, 916; 156/625, 668; 252/79.1, 79.2, 79.4; 400/237

[56] References Cited

U.S. PATENT DOCUMENTS

| | | | |
|---|---|---|---|
| 1,083,007 | 12/1913 | Ellis | 156/668 |
| 2,338,042 | 12/1943 | Kline | 106/27 X |
| 2,382,861 | 8/1945 | Curado | 106/23 |
| 3,105,769 | 10/1963 | Ellerin | 427/141 |
| 3,363,336 | 1/1968 | Skinner | 35/9 G |
| 3,363,337 | 1/1968 | Skinner et al. | 35/36 |
| 3,460,964 | 8/1969 | Dunham | 106/21 |
| 3,847,850 | 11/1974 | Rudolphy | 106/27 X |
| 4,092,280 | 5/1978 | Barough et al. | 428/914 X |
| 4,161,551 | 7/1979 | Barough et al. | 428/539 |

FOREIGN PATENT DOCUMENTS

| | | | |
|---|---|---|---|
| 1373770 | 8/1964 | France | 106/21 |
| 819319 | 9/1959 | United Kingdom | 106/27 |
| 934356 | 8/1963 | United Kingdom | 106/21 |

*Primary Examiner*—Bruce H. Hess
*Attorney, Agent, or Firm*—Lackenbach, Lilling & Siegel

[57] ABSTRACT

The present invention relates to an ink formulation which may be coated on a flexible substratum to produce a typewriter ribbon or the like, wherein impressions made from such a ribbon are capable of adhesive removal shortly after being created on all conventional typing bonds and papers, but which impressions exhibit delayed alteration resistance whereby any attempt at correcting or removing the indicia by pressure sensitive adhesive means or altering the indicia by erasing will leave an obvious and permanent indication that a removal was attempted.

4 Claims, 2 Drawing Figures

PERFORMANCE TEST DAR (Basket Weave Safety Bond)

FIGURE I

PERFORMANCE TEST OF DAR (25% Cotton Trojan Bond)

PERFORMANCE TEST DAR (Basket Weave Safety Bond)

ADHESIVELY CORRECTABLE TRANSFER MEDIUM WITH DELAYED ALTERATION RESISTANCE CHARACTERISTICS

This is a division of application Ser. No. 817,773, filed July 21, 1977 which is a continuation-in-part of application Ser. No. 781,023, filed Mar. 24, 1977, now U.S. Pat. No. 4,161,551.

BACKGROUND OF THE INVENTION

1. Field of the Invention

The present invention relates broadly to a novel transfer media or ink composition, which when coated on a thin flexible substratum is useful in the production of typewriter ribbons, carbon paper and the like, and more particularly to an adhesively correctable film typewriter ribbon having a delayed alteration resistance which is especially adapted for use in conjunction with an adhesive lift off tape of the type that is used to lift off typed indicia. The delayed alteration resistance typewriter ribbon made in accordance with the present invention is especially adapted for use with lift off tapes and typewriters such as the Correcting Selectric typewriter manufactured by Internation Business Machines Corporation. This invention eliminates complete adhesive "lift off" of typewritten indicia from the typing bond after a predetermined time duration while allowing for complete adhesive removal of any image a short time after the indicia is typed or transferred onto typing bond.

2. Description of the Prior Art

Transfer media now in common use and known as "correctable film ribbons" usually comprise a flexible carrier substrate such as polyethylene, or the like on which is coated a pressure sensitive transfer coating. Upon type font impact or stylus pressure such ribbons produce impressions on typing bond paper or similar surfaces. The correction of erroneously typed impressions is accomplished by the utilization of a lift off tape or tabs.

The lift off tapes or tabs consist of a flexible carrier substrate, such as polyethylene terephthalate that is provided on one side with an adhesive coating, which, when brought into firm contact with typed impressions, will adhesively remove or "lift off" such impressions. Corrections made in this manner have the advantage of being virtually invisible. This, however, is also their disadvantage, particularly in the case of legal documents and commercial paper. The ability to correct an error undetectably at some later time can also be used to falsify documents which cannot readily be detected.

SUMMARY OF THE INVENTION

This invention overcomes the disadvantages of the prior art ink formulations by providing a means to form typewritten indicia which are readily initially removable both by adhesive means and by erasure for a short period of time, after which the indicia create a burn or indelible mark in the paper bond underlying the indicia coextensive therewith which remains even after the typed indicia are attempted to be removed. Accordingly, complete adhesive removal of the typewritten image once typed on the typing bond is rendered impossible after a predetermined period of time without leaving a trace.

This invention eliminates unlimited corrections with respect to time by limiting the time period during which a perfect correction can be made by imparting to the indicia produced by a ribbon of the present invention essentially a temporary alteration capability.

It is an object of the present invention to create a typewritten image which cannot be effectively removed after a predetermined period of time by the addition of an agent which reacts with the alpha cellulose content of the receptor sheet or will otherwise increase the bond between the indicia and the receptor sheet.

It is a further object of the present invention to create an imaging ink layer as part of a typewriter ribbon, containing a water soluble salt, thereby giving the ink a delayed alteration resistance.

It is also an object of the present invention to create an imaging ink layer as part of a typewriter ribbon, containing an organic acid, thereby giving the ink a delayed alteration resistance.

It is still yet another object of the present invention to provide an ink layer as part of a typewriter ribbon, which contains a component or components which will migrate gradually toward the typing bond and react therewith to create an indelible image on the paper after the passage of time.

It is a further object of the present invention to provide a simple and inexpensive formulation for producing a delayed alteration resistance ink and typewriter ribbon.

The potential for this invention in the legal and financial communities is enormous. Prior to the advent of adhesively correctable typewritten indicia, any changes that had to be made to a document, check or other commercial paper was by means of erasure or one of many means of opaquing. Since such procedures are completely visible, it necessitated either an initialling of the change or the destruction of the document. If it was a check, it was required to be destroyed.

The widespread usage of correctable film ribbons with its companion lift off tape or tabs has allowed virtually invisible corrections even after indefinite periods of time. Although generally advantageous, its disadvantage of making it possible to alter documents and checks undetected has created severe problems of security not only for the legal and financial users but also for the manufacturer who has been forced to install security devices in the typewriter which prevents the typewriter from accepting a correctable film ribbon. It is a further object of this invention to eliminate these disadvantages.

The foregoing together with various ancillary objects, features and advantages of the present invention will become apparent from the following description of the preferred embodiments, and the accompanying drawings, by way of example only, wherein:

DETAILED DESCRIPTION OF THE INVENTION

Figure 1:
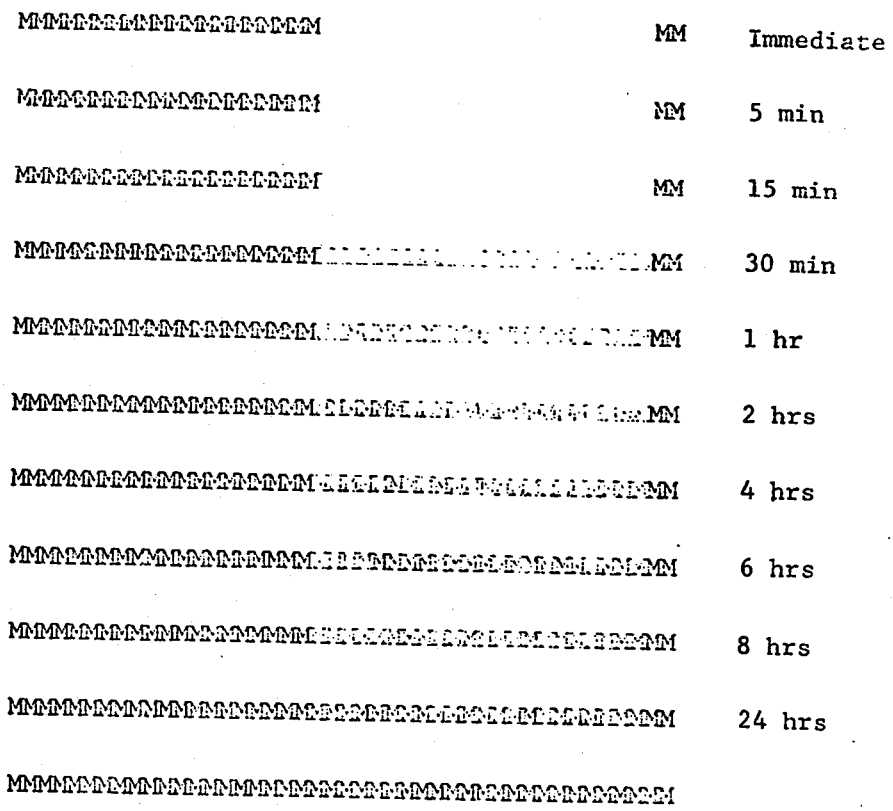
FIG. 1 is a copy of a test using a preferred embodiment ink formulation with a 25% cotton bond paper.

The present invention creates an ink which leaves an image on typing bond or the like on which it is placed, and which leaves an indelible mark after adhesive removal only after the passage of time due to surface etching or a reaction with paper through the addition to a basic ink composition of a suitable reaction agent. Such a reaction agent or compound preferrably fulfills the following criteria: (a) Having at least partial compatibility with the coating composition so as not to substantially upset its stability and its rheological properties; (b) Not unduly affecting the shelf life of the ribbon or coated film; (c) Not detrimentally affecting the imaging quality of the transfer layer; (d) Not detrimentally affecting the initial "lift off" ability (correctability) of typed indicia; and (e) Slowly reacting with, or etch the surface of, or increase the adhesion to the underlaying paper or bond, so as to impair the correctability of typed indicia with the passage of time.

Examples of suitable reaction agents are: water soluble salts and in particular preferrably zinc chloride, strontium chloride, $Cu(OH)_2$ in $NH_4OH$ (Schweizer Solution or reagent), cupric chloride, ammonium acetate, calcium thiocyanate, potassium acetate, barium chloride, potassium permanganate, lithium acetate, strontium hydroxide and iodine trichloride.

Furthermore, preferred reaction agents include organic acids such as bromo acetic acid, monochloro acetic acid, acetic acid, citric acid, tartaric acid and oxalic acid. When these materials are singly or in combination, brought into contact with the surface of typing bond paper as part of the indicia producing transfer of the ink layer, they slowly attack, etch or increase the adhesion to the underlying fibers of the bond paper, thereby making it impossible to remove typed indicia without leaving a distinctive residual image after the lapse of a predetermined period of time. With certain salts such as zinc chloride, it is believed that a process of esterification of the free oxyhydrils present in the alpha cellulose of the typing bond takes place when the etching agent reacts with conventional typing paper. Accordingly, most water soluble salts or organic acids which react with paper will serve to react with conventional typing papers and are compatible in inks and therefore are suitable reaction agents.

The speed of the reaction, and therefore the delayed alteration effect, varies slightly with such conditions as the moisture content of the typing bond, its cotton content and the relative humidity and temperature of the atmosphere. The percentage of the reaction agent in the coating composition also affects the speed of the reaction, the greater the additive content, the faster the reaction.

Generally, percentages of 0.1 to 15% by weight of reaction agent will cause a delayed alteration resistance effect which starts noticeably after 5 to 40 minutes, is obvious after 90 to 300 minutes and maximizes in 16 to 36 hours. However, the preferable range of the reaction agent is usually between 0.2 to 12%, more preferably from 0.5 to 10% and yet more preferably from 0.5 to 6%, and it should be noted that the amount added may differ for varying ink formulations and with the desired delay in reaction time. Also, more than one reaction agent may be utilized at the same time.

The following examples indicate preferred embodiments of reaction agents in connection with preferred base ink formulations. However, it must be noted that all the reaction agents noted are operative in all the basic ink formulations listed. The preferred embodiments listed below set forth parts, as opposed to percentages, of each of the components of the ink compositions including the reaction agent.

The following examples are preferred total ink compositions including reaction agents, which as part of a typewriter ribbon will create impressions which exhibit a delayed alteration resistance after a short period of time but are completely adhesively removable within the short period of time. In all the following examples the coating may be applied by a roller or a roller and wire bar combination to yield a dry coating weight of 2½ lbs. per 3,000 square feet on a suitable carrier or substrate. Furthermore, in all the examples the mixtures were ground in a ball mill for at least 6 hours prior to coating.

| EXAMPLE I | |
|---|---|
| Base Ink: | 8 parts polyamid P 1560 (Lawter Chemical Co.) |
| | 17 parts HB-40 hydrocarbon plasticizer (Monsanto) |
| | 22 parts toluol |
| | 22 parts isopropanol |
| | 2 parts Raven Black 155 |
| Reaction Agent: | 4 parts zinc chloride |

| EXAMPLE II | |
|---|---|
| Base Ink: | 14 parts pliolite resin ACL (Goodyear Chemical Co.) |
| | 10 parts hexyl decyl stearate |
| | 10 parts mineral oil (Sunthene 420) |
| | 7 parts toluol |
| Reaction Agent: | 5 parts strontium chloride |

| EXAMPLE III | |
|---|---|
| Base Ink: | 9 parts polyamid resin (Emery 3749) |
| | 12 parts dioctyl phthalate |
| | 7 parts butyl stearate |
| | 6 parts mogul L (Carbon Black Cabot Co.) |
| | 5 parts petrolatum |
| | 40 parts isopropanol |
| | 20 parts toluol |
| Reaction Agent: | 3 parts Schweizer Solution |

| EXAMPLE IV | |
|---|---|
| Base Ink: | 14 parts piccolastic E125 (Hercules, Inc.) |
| | 4 parts tridecyl stearate |
| | 64 parts toluol |
| | 8 parts Raven Black 1255 |
| | 2 parts black F 8200 |
| | 2 parts magnesium silicate |
| | 3 parts dow corning fluid 200 |
| Reaction Agent: | 2 parts tartaric acid |

| EXAMPLE V | |
|---|---|
| Base Ink: | 12.3 parts piccolastic E125 |
| | 12.3 parts 2 hexyldecyl stearate |
| | 61.0 parts toluol |
| | 7.0 parts Raven Black 1255 |
| | 4.0 parts black F 8200 |
| | 1.5 parts microwax MP 26 (Micro Powders Inc.) |
| Reaction Agent: | 1.0 parts oxalic acid, or |
| | 1.8 parts acetic acid, or |
| | 0.75 parts citric acid |

| EXAMPLE VI | |
|---|---|
| Base Ink: | 14 parts acryloid B67 (Rohm & Haas Co.) |
| | 12 parts isopropyl palmitate (Robinson & Wagner) |
| | 54 parts toluol |
| | 6 parts Raven Black 1255 |
| | 2 parts black F 8200 |
| | 10 parts white mineral oil |
| Reaction Agent: | 3 parts lithium acetate, or |
| | 2 parts strontium hydroxide, or |
| | 2 parts potassium acetate, or |
| | 2.4 parts calcium thiocyanate, or |

-continued

| | |
|---|---|
| | 1.3 parts barium chloride |

EXAMPLE VII

| | |
|---|---|
| Base Ink: | 14 parts pliolite ACL (Goodyear Chemical) |
| | 66 parts toluol |
| | 4 parts 2 hexyldecyl stearate (A. Gross & Co.) |
| | 12 parts Raven Black 1255 |
| | 2 parts GB SF 96 (350) silicon fluid |
| Reaction Agent: | 1.7 parts potassium permanganate, or |
| | 1.9 parts monochloro acetic acid |

EXAMPLE VIII

| | |
|---|---|
| Base Ink: | 14 parts pliolite ACL |
| | 4 parts 2-hexyl decyl stearate |
| | 59 parts toluol |
| | 12 parts Raven Black 1255 |
| | 1 part white mineral oil |
| Reaction Agent: | 2.2 parts cupric chloride, or |
| | 2.3 parts ammonium acetate, or |
| | .75 parts bromo acetic acid, or |
| | .3 parts iodine trichloride |

It has been found that conventional base ink formulations will function to produce delayed alteration resistant indicia when asuitable percentage of the reaction agents noted above are added thereto. Furthermore, it is also possible to include an oil soluble dye as well as one or more of the before mentioned reaction agents in the same formulation and obtain a suitable delayed alteration resistance ink. As noted previously one or more of the reaction agents may be utilized at the same time in the same base ink formulation.

Figure 2:
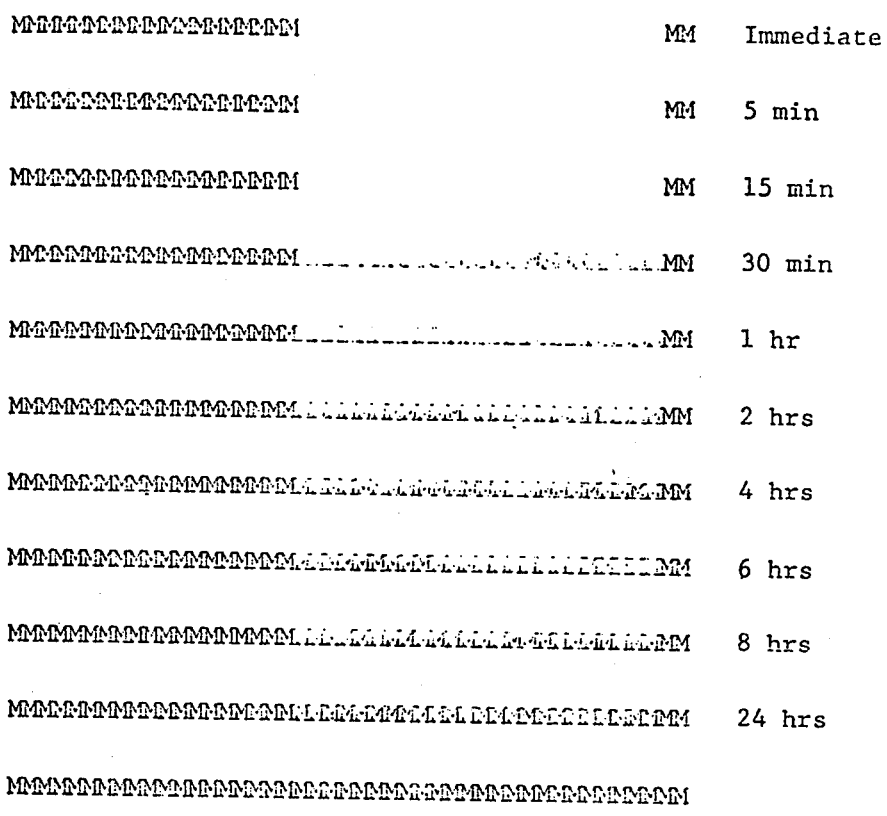
FIG. 2 is a copy of a similar test using the same ink formulation as in FIG. 1 on a basket weave safety bond paper which is commonly used for checks.

The results of performance tests of delayed alteration resistant inks made according to the present invention are shown in FIGS. 1 and 2. In FIGS. 1 and 2 ink according to Example I was utilized and made into a typewriter ribbon. In FIG. 1 the paper is a 25% cotton content typing bond known as Trojan Bond.

In FIG. 2 the paper is a basket weave Safety Bond which is the type of paper most widely used in the imprinting of checks and commercial paper. The test letter in both tests was a capital "M" typed 44 times across the face of the page. All eleven lines were typed consecutively. The typewriter utilized was the IBM Correcting Selectric II typewriter. The typewriter was set at pressure #3.

At various time intervals which are indicated on the right side of the figure, attempts were made to adhesively lift-off approximately half of the letters on the line beginning with the third from the last letter on the line. Such a procedure was chosen in order to provide a contrast with the remaining impressions on the line. The attempts were made using the correction mechanism of the typewriter including a standard adhesive lift-off tape.

The lift-off of the letters on the line marked "immediate" was attempted immediately after all of the eleven lines of the test were typed. As can be readily seen, total lift-off was successfully accomplished in that no discernible image was left. The next attempt was made 5 minutes later, and, as can be seen from the line so marked, a very slight trace of the impression may be discerned upon close examination.

Fifteen minutes after typing, another attempt was made to lift-off the impression in the third line in both tests, and as readily seen there are indelible indications of resistance to alterations. Generally, the resistance to alteration increases as time progresses until about 6–8 hours when the image of the typed character attempted to be adhesively lifted-off is discernible and finally, at the end of 24 hours, the image is clearly visible and it is as if no attempt was made to lift it off.

The same test procedure was repeated in both the tests whose results are shown in FIGS. 1 and 2. The results achieved were similar, however, the Basket Weave Safety Bond exhibits a residual image which can be detected after five minutes. The 25% cotton typing bond is a conventional typing paper and similar tests with varying papers ranging up to 100% cotton exhibit substantially similar results at all different typing pressure levels.

Similar tests have been made utilizing the various other formulations disclosed herein with similar results being obtained. Furthermore, the reaction agents are operative with all the several base ink formulations disclosed, the preferred embodiments only being set forth in the examples.

While the examples above serve to describe and illustrate suitable and preferred compositions of correctable ink formulations in accordance with the present invention, said ink formulations being especially suitable to produce an image yielding transfer layer for a typewriter ribbon, it should be understood that various changes, omissions and substitutes to the preferred embodiments may be made by those skilled in the art, without departing from the scope of the present invention.

What is claimed is:

1. In a typewriter ribbon having a thin flexible substratum and an image yielding transfer layer capable of producing indicia which, in connection with typing bond, are initially adhesively removable and exhibit a delayed alteration resistance, wherein the improvement comprises said transfer layer including a water soluble salt which reacts with paper, said water soluble salt being selected from the group consisting of cupric chloride, ammonium acetate, calcium thoicyanate, potassium acetate, barium chloride, potassium permanganate, lithium acetate, iodine trichloride and strontium hydroxide.

2. A typewriter ribbon as in claim 1, wherein the content of the water soluble salt is between 0.2 to 12% by weight of the total ink formulation.

3. In a typewriter ribbon having a thin flexible substratum and an image yielding transfer layer capable of producing indicia which, in combination with typing bond, are initially adhesively removable and exhibit a delayed alteration resistance, wherein the improvement comprises said transfer layer including an organic acid which reacts with paper, said organic acid being selected from a group consisting of bromo acetic acid, monochloro acetic acid, acetic acid, citric acid, tartaric acid and oxalic acid.

4. A typewriter ribbon as in claim 3, wherein the content of the organic acid is between 0.2 to 12% by weight of the total ink formulation.

* * * * *